United States Patent [19]

Thomas et al.

[11] 3,963,545

[45] June 15, 1976

[54] ENERGETIC DOUBLE BASE PROPELLANT COMPOSITION

[75] Inventors: William E. Thomas, Lacey's Spring; Thomas E. Martin, Blountsville, both of Ala.

[73] Assignee: The United States of America as represented by the Secretary of the Army, Washington, D.C.

[22] Filed: Nov. 8, 1974

[21] Appl. No.: 522,161

[52] U.S. Cl. ..... 149/92; 149/97; 149/98; 149/108.2; 149/100

[51] Int. Cl.[2] ..... C06B 25/34; C06B 25/24; C06B 25/26; C06B 25/02

[58] Field of Search ..... 149/98, 97, 96, 99, 149/100, 108.2, 92, 14, 15

[56] References Cited

UNITED STATES PATENTS

| | | | |
|---|---|---|---|
| 3,103,458 | 9/1963 | Besser | 149/98 |
| 3,228,338 | 1/1966 | McEwan | 149/98 |
| 3,496,870 | 2/1970 | Fulmer | 149/98 |
| 3,549,436 | 12/1970 | La Rocca | 149/15 |
| 3,715,414 | 2/1973 | Schultz | 149/14 |
| 3,860,678 | 1/1975 | Martin | 149/14 |
| 3,886,006 | 5/1975 | Martin | 149/98 |

*Primary Examiner*—Benjamin R. Padgett
*Assistant Examiner*—Donald P. Walsh
*Attorney, Agent, or Firm*—Nathan Edelberg; Robert P. Gibson; Jack W. Voigt

[57] ABSTRACT

An energetic double base propellant composition consisting essentially of nitrocellulose and nitroglycerin as the major ingredients with about 48–52 weight percent of the propellant composition being nitrocellulose and about 40–44 weight percent of the propellant composition being nitroglycerin, and the minor ingredients comprised of about 2–4 weight percent di-n-propyladipate, about 2–2.5 weight percent 2-nitrodiphenylamine, about 0.1–0.2 weight percent candelilla wax, and about 1.0–1.3 weight percent aluminum is disclosed.

2 Claims, 1 Drawing Figure

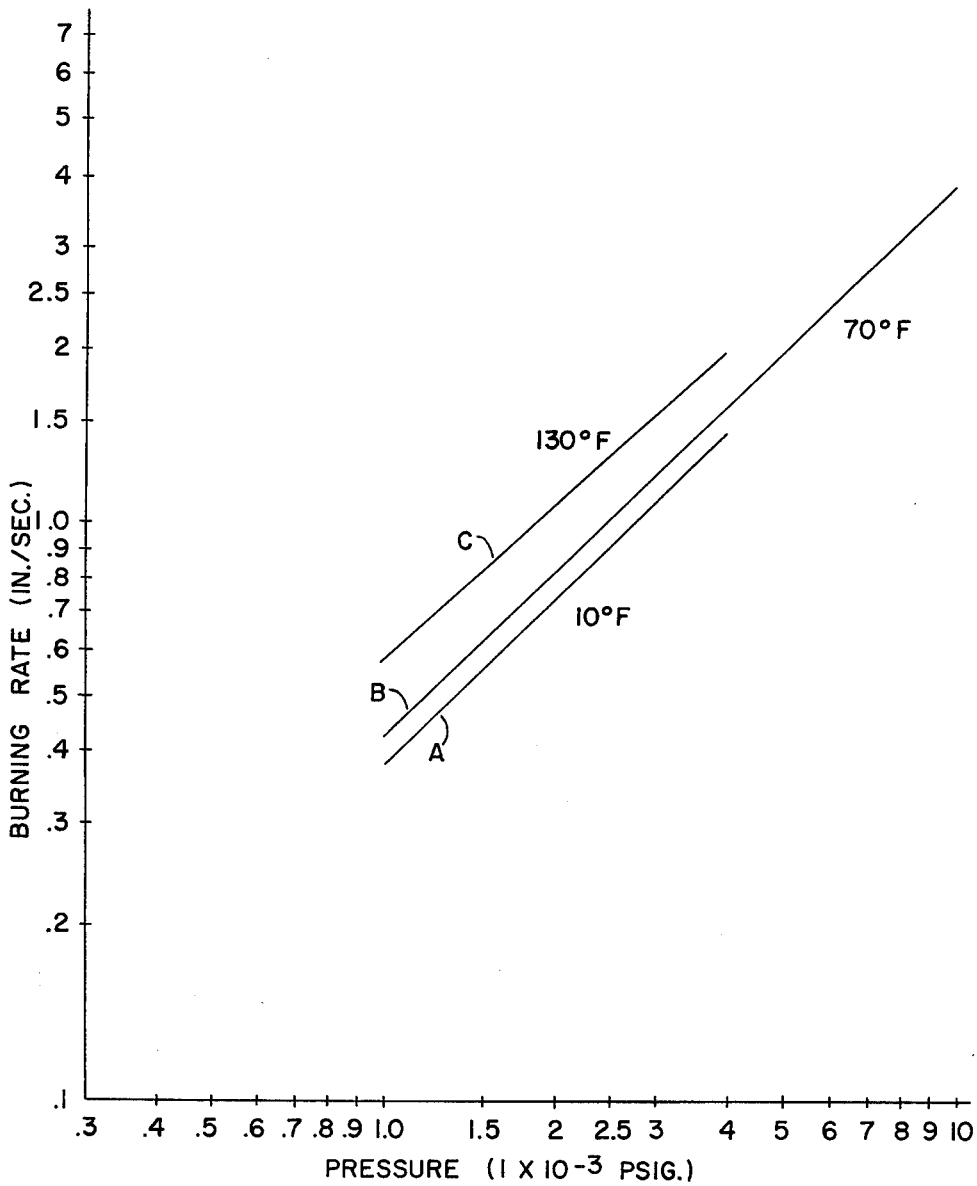
BURNING RATE (IN./SEC.)
7
6
5
4
3
2.5
2
1.5
1.0
.9
.8
.7
.6
.5
.4
.3
.2
.1
.3 .4 .5 .6 .7 .8 .9 1.0 1.5 2 2.5 3 4 5 6 7 8 9 10
PRESSURE (1 X 10-3 PSIG.)
70°F
130°F
10°F
A
B
C

ENERGETIC DOUBLE BASE PROPELLANT COMPOSITION

DEDICATORY CLAUSE

The invention described herein may be manufactured, used, and licensed by or for the Government for governmental purposes without the payment to us of any royalties thereon.

BACKGROUND OF THE INVENTION

Double base propellant compositions which contain nitrocellulose, nitroglycerin, selected organic or inorganic salts for ballistic or stabilizer functions, and additives such as carbon black are generally considered normal double base propellant compositions. When an inorganic oxidizer salt is added to the formulation the term modified double base or composite double base is generally employed. Other compounds such as coating agents may be used with the inorganic oxidizer salt to achieve the desired properties in the finished propellant. The composite propellant compositions may include metal fuel along with other compounds which serve as ballistic modifiers, plasticizers, or processing aids. The propellants can be cast, extruded, or rolled depending on the formulation and the desired shape required for the cured propellant which is referred to as a propellant grain.

The burning rate curve, where burning rate is plotted against puressure, provides useful information to the propulsion engineer in designing a motor case for a particular mission. Also, the burning rate exponent of a propellant is another indicator to the artisan what advantages or disadvantages a propellant may offer. When the burning rate exponent is high the design problems for the motor case are more complex. Some propellants with an almost flat burning rate curve will have a low burning rate exponent. The motor case for a rocket motor using a plateau or mesa type propellant (i.e., where the burning rate is fairly constant over a wide pressure range) is quite different and less complex to design than where the motor case chamber pressure is extremely high, the propellant burning rate high, the the propellant burning rate exponent high. The grain design or construction can also be tailored to produce the desired burning rate pressure relationship.

Desirable for use in small diameter rocket motors would be a propellant with the highest burning rate at elevated pressures while having a lower burning rate exponent. Also desirable is a propellant having the lower burning rate exponent and one not susceptible to resonance burning.

Therefore, an object of this invention is to provide a propellant composition having a lower pressure exponent with a higher burning rate at elevated pressure.

Another object of this invention is to provide a propellant composition which is not susceptible to resonance burning.

SUMMARY OF THE INVENTION

The formulation of the double base propellant composition of this invention is listed below by ingredients, in range of weight percentage, and in nominal weight percentage of each ingredient. The nominal weight percentage is preferred for use over a burning rate range from about 0.37 to about 4.0 and over a range of pressures from 1,000 to 10,000 Psig.

| Ingredients | Range of Weight Percentage | Nominal Weight Percentage |
|---|---|---|
| Nitrocellulose | 48–52 | 51.0 |
| Nitroglycerin | 40–44 | 42.3 |
| Di-N-Propyladipate | 2–4 | 3.4 |
| 2-Nitrodiphenylamine | 2–2.5 | 2.1 |
| Candelilla Wax | 0.1–0.2 | 0.1 |
| Aluminum | 1.0–1.3 | 1.1 |

BRIEF DESCRIPTION OF THE DRAWING

FIG. 1 shows burning rate curves A, B, and C (inches per second plotted against pressure, Psig, for propellant burnings at 10°F, 70°F and 130°F respectively) for the nominal formulation of the double base propellant composition of this invention.

DESCRIPTION OF THE PREFERRED EMBODIMENT

The energetic double base propellant composition of this invention has a higher burning rate, a higher energy level, and it is not susceptible to resonance burning or combustion instability as compared to normal double base propellant compositions. Th burning rate exponent of this propellant is also higher when compared with the burning rate exponent of a composite double base propellant having potassium perchlorate oxidizer, carbon black additive, and nitrocellulose and nitroglycerin as the major ingredients. When compared to a double base propellant which can be extruded or rolled, the burning rate exponent is lower and the burning rate is higher with increased pressure.

The preferred composition in weight percent of each ingredient is set forth below.

| Indredients | Weight Percent |
|---|---|
| Nitrocellulose | 51.0 |
| Nitroglycerin | 42.3 |
| Di-n-propyladipate | 3.4 |
| 2-Nitrodiphenylamine | 2.1 |
| Candelilla Wax | 0.1 |
| Aluminum | 1.1 |

In referring to the drawing, the curves A, B, and C illustrate the high burning rates at higher pressures whether the burning takes place in propellant stored at 10°F, 70°F, or 130°F. Also the fairly consistent burning rates over the wide temperature range from 10°F to 130°F with almost a linear relationship of the burning rate increase with a wide increse in pressure offer a distinct advantage for a tactical employment of the propellant in weaponry.

For comparison purposes a propellant of the prior art intended for similar use as the propellant of this invention has a burning rate of 0.695 inches/second at 1000 psi and at about 70°F and the burning rate exponent is about 0.77. The propellant of this invention has a burning rate of about 0.43 inches/second at 1000 psi and at about 70°F with much higher burning rates at higher pressures and with a lower burning rate exponent.

Recent developments in the propellant art indicate the need for a propellant which can be rolled and cured to thin sheets and then subsequently consolidated with a reinforcing screen by proper control of consolidation temperature and pressure. The propellant of this invention can meet the requirements of the consolidation procedures and at the same time, contribute the added advantages of higher burning rate under increased pressure while having a lower burning rate exponent.

The propellant of this invention is a solventless propellant which can be extruded into thicker web grains than a solvent type propellant (e.g. M-7) because it does not have a drying problem of removing solvent. For some uses this extruded thicker web offers a very distinct advantage --not only in production but also in the use of the grain where additional burning time or mechanical strength is required.

We claim:

1. An energetic double base, solventless, extrudable propellant composition consisting essentially of about 48-52 weight percent of nitrocellulose, about 40–44 weight percent of nitroglycerin, about 2–4 weight percent of di-n-propyladipate, about 2-2.5 weight percent of 2-nitrodiphenylamine, about 0.1–0.2 weight percent candelilla wax, and about 1.0–1.3 weight percent aluminum.

2. The propellant composition of claim 1 wherein said nitrocellulose is present in an amount of about 51.0 weight percent, said nitroglycerin is present in an amount of about 42.3 weight percent, said di-n-propyladipate is present in an amount of about 3.4 weight percent, said 2-nitrodiphenylamine is present in an amount of about 2.1 weight percent, said candelilla wax is present in an amount of about 0.1 weight percent, and said aluminum is present in an amount of about 1.1 weight percent.

* * * * *